US005590930A

United States Patent [19]

Glockl

[11] Patent Number: 5,590,930

[45] Date of Patent: Jan. 7, 1997

[54] ACTIVE DYNAMIC SEAT

[76] Inventor: Josef Glockl, Ammerseestrasse 6,, D-8011 Kirchheim, Germany

[21] Appl. No.: 150,105

[22] PCT Filed: Mar. 29, 1993

[86] PCT No.: PCT/EP93/00760

§ 371 Date: Feb. 24, 1994

§ 102(e) Date: Feb. 24, 1994

[87] PCT Pub. No.: WO93/19646

PCT Pub. Date: Oct. 14, 1993

[30] Foreign Application Priority Data

Mar. 27, 1992 [DE] Germany ..... 42 10 097.6

[51] Int. Cl.[6] ..... A47C 1/02

[52] U.S. Cl. ..... 297/313; 297/258.1; 297/452.21; 297/440.1

[58] Field of Search ..... 297/313, 314, 297/318, 337, 344.26, 344.21, 195.11, 195.1, 208, 209, 258, 272, DIG. 2, DIG. 1, 452.27, 258.1, 272.1, 452.21, 452.22, 452.23, 452.26

[56] References Cited

U.S. PATENT DOCUMENTS

| | | | |
|---|---|---|---|
| 621,139 | 3/1899 | Reuter | 297/314 X |
| 2,048,148 | 7/1936 | Stoll . | |
| 2,132,291 | 10/1938 | Fitos | 297/314 X |
| 2,719,571 | 10/1955 | Taylor . | |
| 2,920,685 | 1/1960 | Trebilcock | 297/314 |
| 2,935,120 | 5/1960 | Naus | 297/344.21 X |
| 4,077,665 | 3/1978 | Storch | 297/452.61 X R |
| 4,099,697 | 7/1978 | Von Schuckmann | 297/314 X |
| 4,862,540 | 9/1989 | Savenije | 5/477 X R |
| 4,974,904 | 12/1990 | Phillips et al. . | |
| 5,048,893 | 9/1991 | Cowan et al. | 297/313 X |

FOREIGN PATENT DOCUMENTS

| | | | |
|---|---|---|---|
| 1534784 | 8/1968 | France . | |
| 1099142 | 2/1961 | Germany | 297/318 |
| 1878921 | 7/1963 | Germany . | |
| 1205666 | 11/1965 | Germany . | |
| 1779141 | 9/1971 | Germany . | |
| 3513985 | 10/1986 | Germany | 297/313 |
| 607071 | 7/1960 | Italy | 297/344.26 |
| 0422254 | 4/1967 | Switzerland . | |
| 8906101 | 7/1989 | WIPO . | |
| 9201410 | 2/1992 | WIPO . | |

*Primary Examiner*—Milton Nelson, Jr.
*Attorney, Agent, or Firm*—Birch, Stewart, Kolasch & Birch, LLP

[57] ABSTRACT

An active dynamic seat has a base, an intermediate part linked to the base and a seating part linked to the intermediate part. The seating part has on its lower side a shell-shaped, downwardly convex seating bowl. The seating part is supported in the vertical direction on a bearing arranged on a head part of the intermediate part that engages the shell-shaped lower side of the seating bowl, and is mounted so as to tilt in all other directions.

22 Claims, 5 Drawing Sheets

FIG. 5
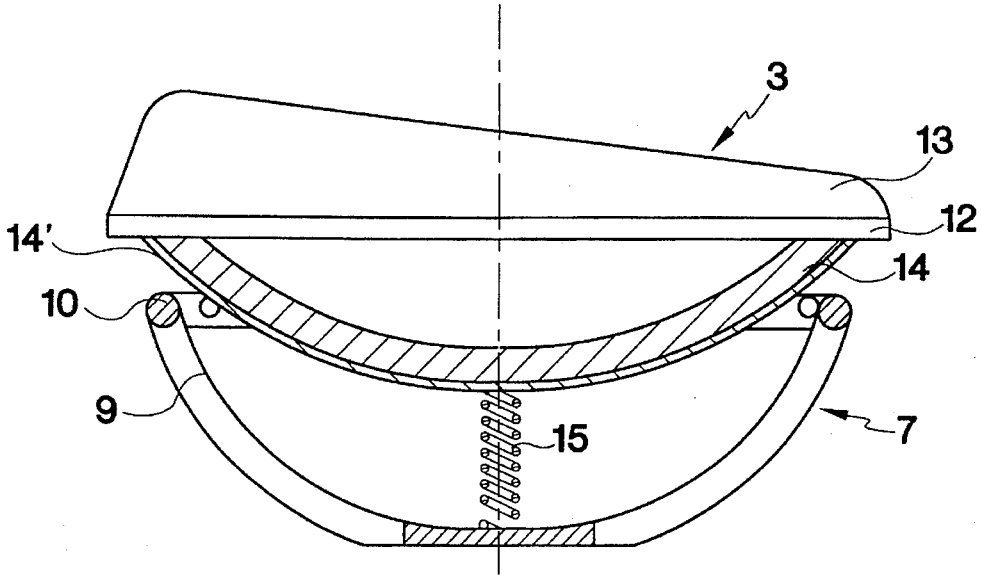
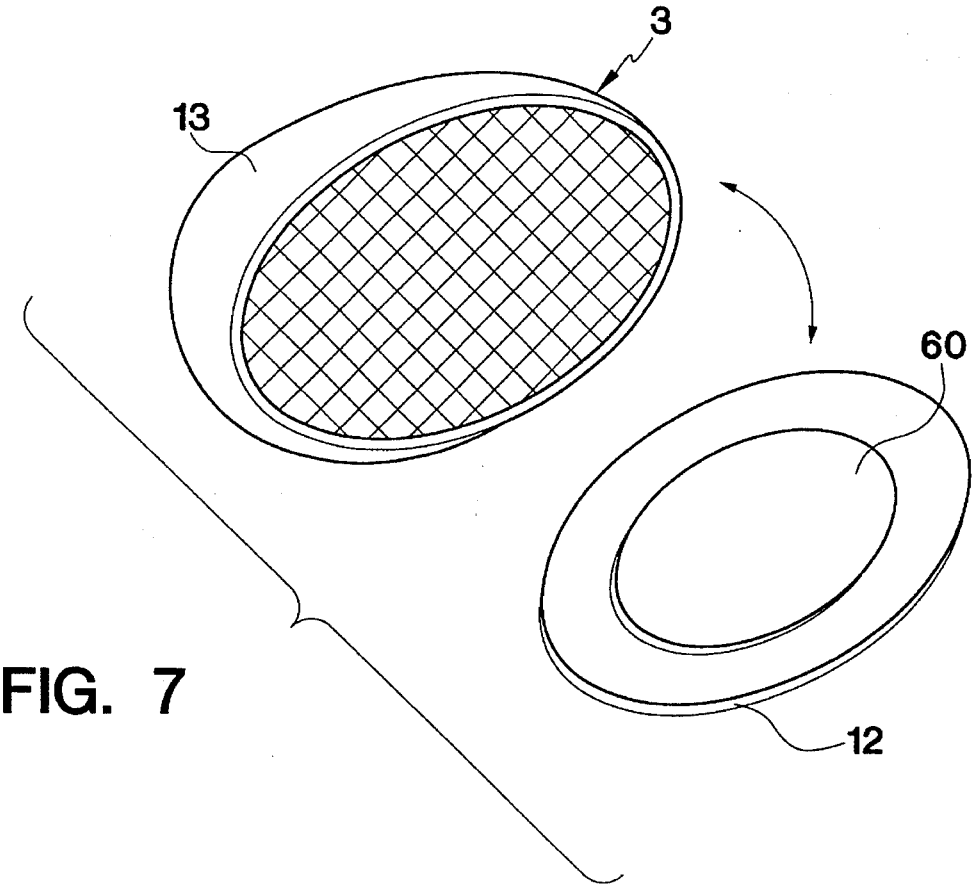
FIG. 7

ACTIVE DYNAMIC SEAT

The invention relates to an active dynamic seat.

BACKGROUND OF THE INVENTION

Conventional seating furniture is designed in most cases so that the body, especially the back, is supported by correspondingly fashioned seating surfaces and backs in an anatomically maximally favorable position. Although such seating furniture is frequently felt to be comfortable, there is the decisive drawback that the body sits merely passively on such seats, i.e. the back muscles are hardly stressed, and the intervertebral disks are stressed merely statically in the "pressure mode". As a result, a long-term usage of such seat furnishings leads to degeneration of the back muscles and wasting of the intervertebral disks. Impairment of health and pains in the back and hip regions (e.g. sciatica) are the frequent consequence of such static and passive sitting.

For this reason, seating furnishings have been developed permitting a so-called active dynamic sitting wherein the back musculature and the intervertebral disks are constantly slightly active. This active dynamic sitting attitude is attained in practically all cases by maintaining the actual seat of the seating furniture in a labile position and making it optionally additionally resilient in the vertical direction.

Such an active dynamic seating device has been described, for example, in DE 73 11 140. This seat consists essentially of a seat part connected via a first tilting joint with a supporting shank, the latter, in turn, being articulated by means of a second tilting joint to the base of the seating device. In this arrangement, each tilting joint consists preferably of a cap formed respectively at the end of the supporting shank, this cap being guided in a hollow cylinder and stressed by a coil spring arranged in the hollow cylinder.

On account of the planar structure of the underside of the cap, the latter is in contact, in the non-stressed condition, with the bottom or, respectively, top of the hollow cylinder so that, without stress, a perfect alignment is achieved of base, supporting shank, and seat. When stress is exerted on this seating device, the two coil springs of the tilting joints are compressed, the two caps being urged into the two hollow cylinders. The tilting movement of these two joints is attained by the feature that the bore in the top of the lower cylinder or, respectively, in the bottom of the upper hollow cylinder is slightly larger than the outer diameter of the supporting shank.

However, the disadvantage arises herein that the maximally possible tilting angle of each tilting joint in the stressed condition is dependent on the distance of the planar side of the cap from the bottom or top of the hollow cylinder and thus on the weight of the person presently using this seating device. Moreover, it is extremely difficult to maintain one's balance on this seating device so that, at least for inexperienced users, there must be the possibility that at least one of the tilting joints is blocked. This results from the fact that, upon deflection of the tilting joint at the base of the seating device into a specific direction, a deflection of the upper tilting joint in the same direction takes place in a preferred manner.

SUMMARY OF THE INVENTION

The invention is based, therefore, on the object of providing an active dynamic seat ensuring, on the one hand, a seating position active to an adequate extent and, on the other hand, permitting a harmless use of the seating device even without a prolonged training phase and/or familiarization phase.

Moreover, the invention is based on the task of creating an active dynamic seat that can be produced in a simple and economical way.

The shell-shaped, downwardly convex design of the underside of the seat part permits, in a simple way, the supporting of the seat part, for example, by means of a ball bearing race arranged at a head section of the intermediate piece. The seat part is thus supported in wobble fashion, i.e. rotatably mounted about two mutually perpendicular axes, both axes of rotation lying in a plane perpendicular to the vertical axis of the intermediate piece.

The actual fulcrum of the seat part is thus located—depending on the design of the seat part—in most cases above the actual seating surface.

On account of the free wobble capability of the seat part of the seating device according to this invention, an active-dynamic seating is ensured, on the one hand. On the other hand, it is ensured by the position of the fulcrum or wobble center that the seat can be utilized without any long period of familiarization even by practically untrained persons since the equilibrium of the seat according to this invention is not labile to the great extent displayed by heretofore known active dynamic seating devices.

These advantages are attained analogously in a further embodiment of the invention wherein the seat part is not capable of wobbling but rather is arranged to be displaceable in a substantially horizontal plane on the head part of the intermediate piece.

In a further development of the invention, a device for resetting into the neutral position can be arranged, or engaged, at the seat part. This restoring device is fashioned, for example, as a tension spring or rubber band disposed at the wobble-mounted seat part and at the intermediate piece, or as a-restoring weight located at the bottom of the seat part.

According to another embodiment of the invention, the intermediate piece can be designed to be vertically resilient in order to improve the sitting comfort.

Additional embodiments of the invention can be derived from the dependent claims.

BRIEF DESCRIPTION OF THE DRAWINGS

The invention will be described in greater detail below with reference to embodiments illustrated in the drawings wherein:

FIG. 5 shows a surface layer portion of the seat shell.

FIG. 7 shows the affixing means for selectively affixing a seat cushion to a seat plate.

DETAILED DESCRIPTION OF THE EMBODIMENTS

Figure 1:
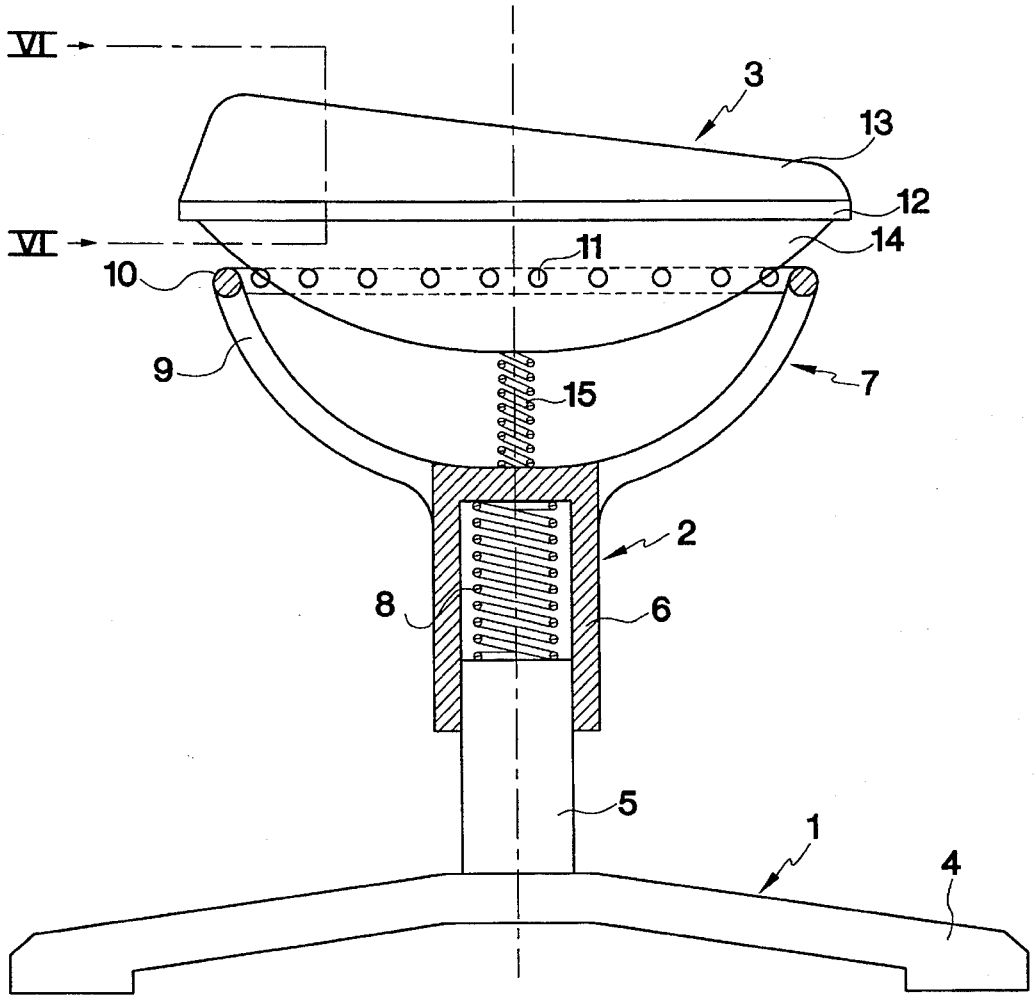
FIG. 1 shows a first embodiment of the seat according to this invention.

The embodiment of the active dynamic seating device of this invention illustrated in FIG. 1 consists of a base 1, an intermediate piece 2 connected thereto, and a seat part 3.

The base 1 exhibits several feet 4, for example five of them, in order to ensure a secure standing of the seating device. However, the base 1 can, of course, also assume any desired other shape suitable for ensuring the stability of the seating device, such as, for instance, a circular plate curved in a slightly convex fashion in the upward direction. Furthermore, several casters can be arranged at the base 1 to permit shifting of the seating device.

In another embodiment, not illustrated, the base 1 can also exhibit a contact surface that is curved in a slightly convex fashion in the downward direction, likewise facilitating the displacement of the seating device on account of the smaller supporting surface. Moreover, it has been found that such a very slight convex curvature of the contact surface—with a diameter of the base of about 50 cm to 60 cm, the marginal zone of the base should have a spacing of about 0.5 cm to 1 cm from a planar contact surface—has a positive effect on the desired sitting attitude on account of the additional wobbling of the entire seat made possible by this feature.

A cylindrical part 5 of the intermediate piece 2 is arranged in the vertical axis of the base 1; this cylindrical part engages into a hollow-cylindrical extension 6 of the head part 7 of the intermediate piece 2. The internal diameter of the hollow-cylindrical extension 6 here corresponds essentially to the outer diameter of the cylindrical part 5 so that the latter is guided in the vertical direction in the hollow-cylindrical extension 6.

For a resilient structure of the intermediate piece 2, a coil spring 8 is arranged between the upper wall of the hollow-cylindrical extension 6 and the top surface of the cylindrical part 5. In order to prevent the hollow-cylindrical extension 6 from being pulled off the cylindrical part 5, the uppermost and, respectively, lowermost winding of the coil spring 8 is connected, by a mounting device not shown in detail, to the upper wall of the hollow-cylindrical extension 6 and, respectively, to the topside of the cylindrical part The head part 7 of the intermediate piece 2 consists of several arms 9 extending in arcuate shape upwardly, a ring 10 being attached to the upper ends of these arms. Several balls 11 rotatably mounted in cages not shown in detail are arranged at this ring 10 at preferably equidistant spacings; these balls constitute a ball bearing for the seat part 3.

The seat part 3 consists of a substantially circular plate 12, a seat cushion 13 being arranged on the topside thereof. The seat cushion 13 can consist, for example, of fabric-covered foam material the foam material constituting the core structure 13', and can optionally be joined to the plate 12 in a fixed or selectively releasable fashion, as by known conventional selective affixing means 60 shown by a block in FIG. 7. To promote an anatomically favorable able sitting attitude, the seat cushion 13 can have a convex, concave, planar, or wedge-shaped design. In case of a wedge-shaped configuration, the higher end of the wedge should be located in the back of the seated person.

Figure 6:
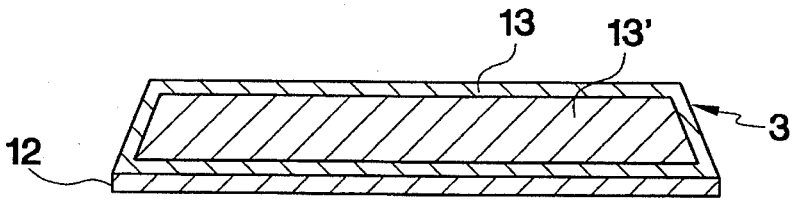
FIG. 6 show a core structure of the seat cushion along the section lines VI—VI shown in FIG. 1.

Furthermore, the seat cushion can exhibit, in a preferred embodiment, a dimensionally stable core in order to maintain the shape desired for improving the sitting attitude even under load to a substantial extent. FIG. 6 shows the seat cushion core structure which is dimensionally stable even under load.

A seat shell 14 which is designed to be convex in the downward direction is formed on the underside of the plate 12; this seat shell rests with its bottom surface on the balls 11 arranged at the ring 10 and thus is supported in wobble fashion. The seat shell 14 herein has-preferably the configuration of a spherical section.

In order to limit the wobbling motion of the seat part 3, the diameter of the plate 12 is chosen to be larger than the diameter of the ring 10 and the upper diameter of the seat shell 14 so that the ring 10 simultaneously forms a stop for the plate 12 in every direction. The maximum tilting angle of the seat part 3—preferably about 10° to 20°—is determined by the appropriate choice of the diameter of the ring 10 in dependence on the form or radius of the seat shell 14.

In order to reset the seat part 3 into the neutral position in case there is no load thereon, the embodiment of this invention as shown in FIG. 1 has a restoring device 15 engaging in the vertical axis at the bottom of the seat shell 14 and, respectively, at the head part 7. The restoring device 15 can be designed in this arrangement as a coil spring, a rubber band, or some other resilient element and can optionally be already pretensioned in the neutral position. Thereby, the lifting off of the seat part 3 from the remainder of the seating device is prevented at the same time.

Instead of providing a ball bearing for the seat shell 14, the head part of the intermediate piece can also be fashioned as a shell with a substantially identical radius, open in the upward direction, so that the seat part 3 is supported in sliding fashion in the head part 7 of the intermediate piece 2, this head part being designed as a shell. For this purpose, the convex bottom side of the seat shell 14 and/or the concave inner surface of the head part 7 can consist of, or be covered with, a flexible but dimensionally stable material in order to ensure flat contact and thus uniform tilting motion. For this purpose, the surfaces sliding on each other should be made of, or be covered with, a material having a low friction coefficient so that a correspondingly smooth-operating support is ensured for the seat part 3. FIG. 5 shows a surface covering or surface layer portion 14' of the seat shell 14.

Figure 2:
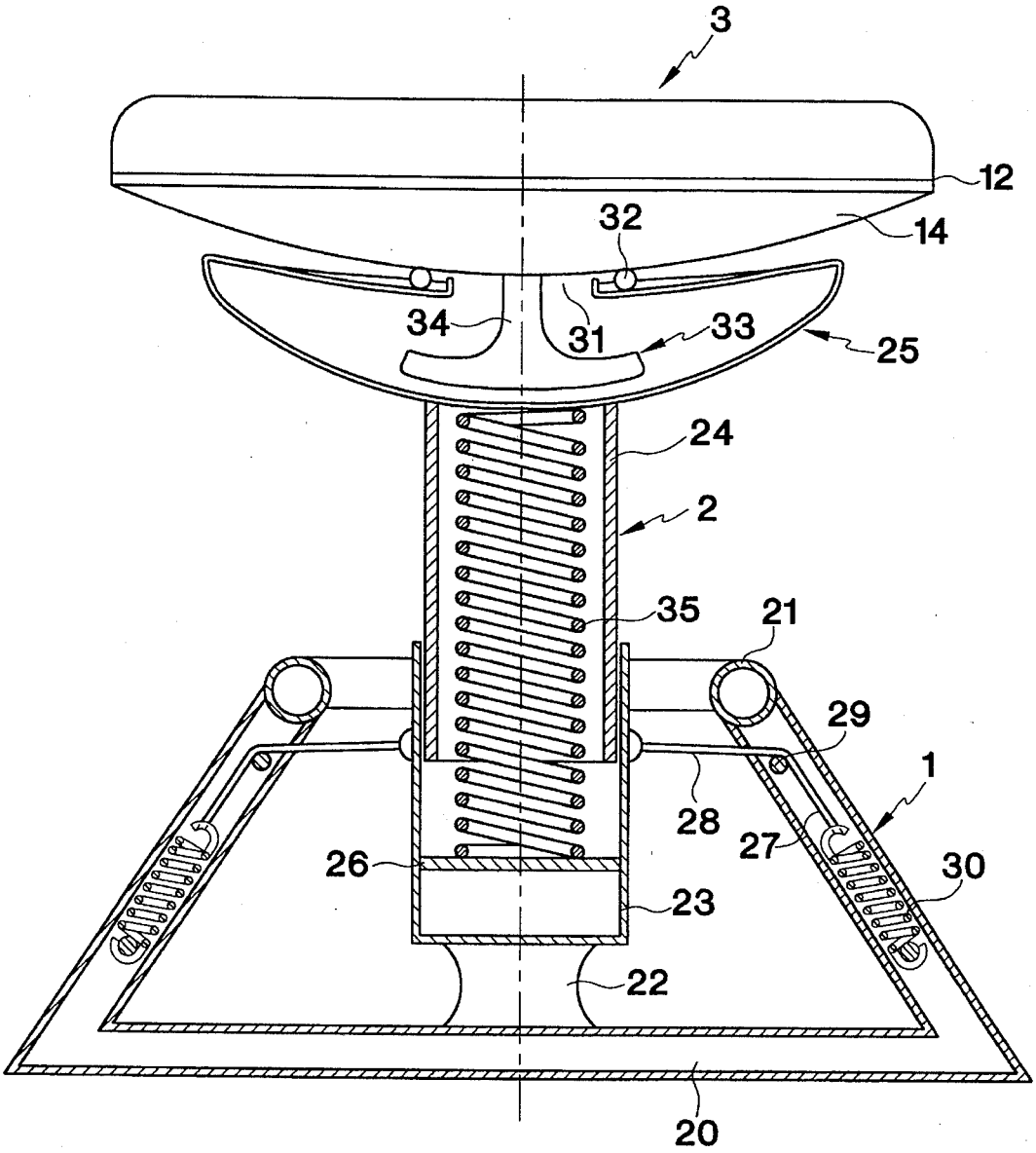
FIG. 2 shows a second embodiment of the seat according to the invention.

The embodiment of the invention shown in FIG. 2 likewise comprises a base 1, an intermediate piece 2, as well as a seat part 3.

The base 1 consists essentially of a base part 20 in the form of a hollow conical section or of several feet, preferably five of them. The base part 20 is double-walled and thus is designed to be hollow on the inside. The upper ends of the inner and outer walls of the hollow conical section are integrally connected with a limiter ring 21.

The intermediate piece 2 is connected with the bottom of the base part 20 by way of a flexible element 22. The flexible element 22 can preferably be designed as a vibration mount.

The upper end of the flexible element 22 is connected to a lower hollow cylinder 23 of the intermediate piece 2. A hollow-cylindrical extension 24 of the head part 25 of the intermediate piece 2 engages into the hollow cylinder 23, the outer diameter of the hollow-cylindrical extension 24 corresponding substantially to the inner diameter of the lower hollow cylinder 23 in order to ensure guidance of the hollow-cylindrical extension 24 in the vertical direction. Within the nesting hollow cylinders, a coil spring 35 is arranged to make the intermediate piece 2 resilient in the vertical direction. The coil spring 35 is attached, preferably by means of mounting devices not shown in detail, to the underside of the head part 25 as well as to an intermediate bottom 26 arranged in the lower hollow cylinder 23. The intermediate bottom 26 here serves simultaneously as a stop for the hollow-cylindrical extension 24; the position of the optionally adjustably designed intermediate bottom 26 within the lower hollow cylinder 23 must be selected in a corresponding way.

Furthermore, several restoring devices 27 engage the lower hollow cylinder 23, distributed at a certain level over the periphery of this lower hollow cylinder. These restoring devices can consist, as shown in FIG. 2, of flexible tension elements 28 attached at the periphery of the lower hollow cylinder 23 which are connected through an opening and a deflection element 29 with coil springs 30 attached in the interior of the sidewalls of the base part 20. The coil springs 30 are preferably pretensioned even in the neutral position of the intermediate piece 2.

The restoring devices 27 can, however, also be designed in some other way, of course, and need not be arranged in the interior of the base part 20.

The head part 25 consists of a hollow member, a central, substantially circular opening 31 being formed in the upper wall of this member. The upper wall is of a slightly shell-shaped design, i.e. concave in the upward direction, and comprises several balls 32 rotatably supported in cages along an imaginary circular line lying concentrically to the vertical axis of the intermediate piece; these balls form a ball bearing for the seat part 3.

The seat part 3 is substantially identical to the seat part of the embodiment in FIG. 1. The sole difference resides in that the diameter of the plate 12 need not necessarily be chosen to be larger than the upper diameter of the seat shell 14 since the limitation of the wobbling movement of the seat part 3 takes place by the cooperation of the central opening 31 in the upper wall of the head part 25 with a restoring weight arranged on the underside of the seat shell 14 in the vertical axis. The restoring weight 33 exhibits for this purpose a cylindrical neck 34 in its upper zone connected with the seat shell 14; this neck, in conjunction with the inner wall of the central opening 31, restricts the wobbling motion of the seat part 3.

In its lower zone, the diameter of the restoring device 33 is preferably dimensioned to be larger than the diameter of the central opening 31, on the one hand in order to prevent lifting off of the seat part 3 from the head part 25 and, on the other hand in order to provide a corresponding volume for the production of an adequate weight force. The weight of the restoring weight 33 must, in any event, be chosen to be so large that the center of gravity of the entire seat part 3 comes to lie below the horizontal plane determined by the balls 32 to ensure resetting of the unstressed seat part 3 into the neutral position.

Figure 3:
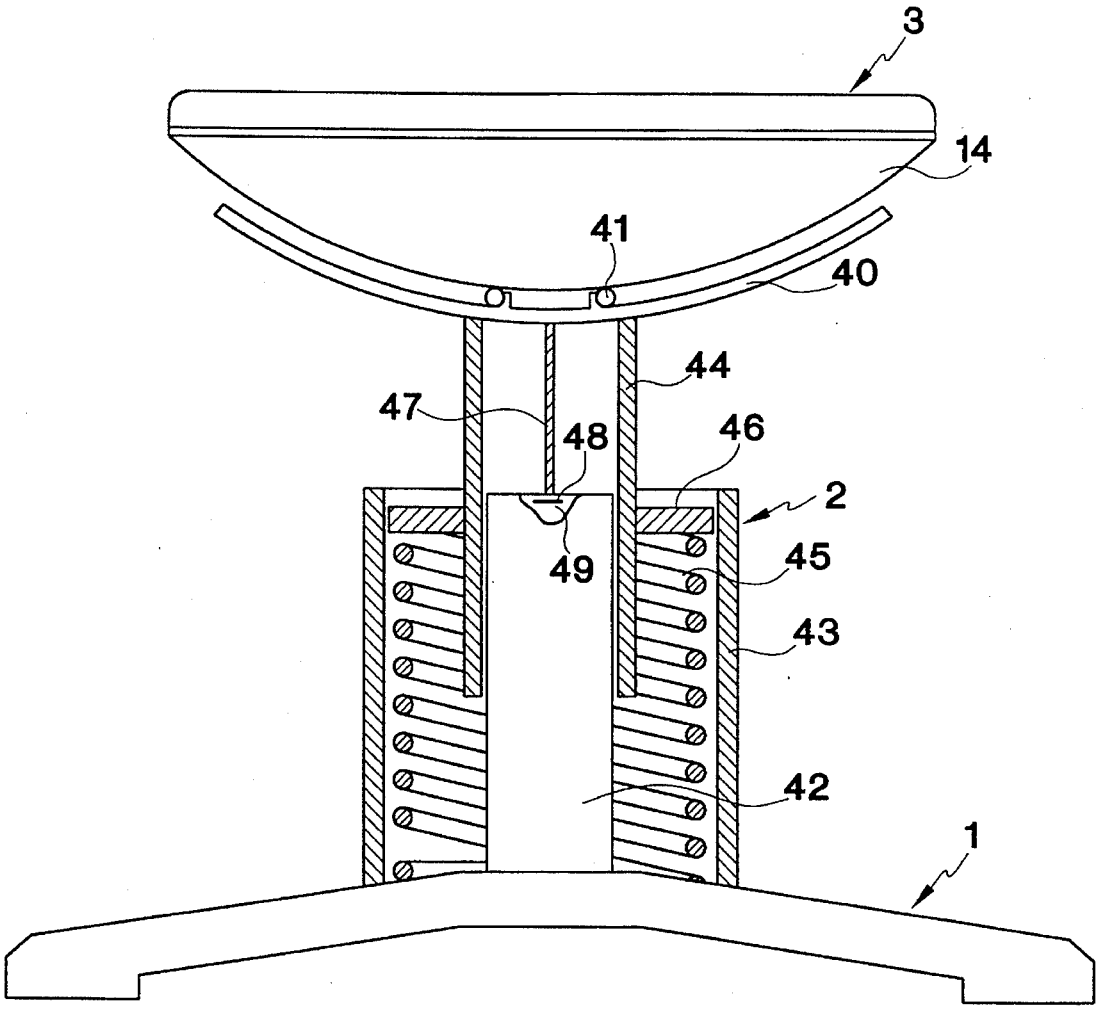
FIG. 3 shows a third embodiment of the seat according to the invention.

The third embodiment of a seating device of this invention illustrated in FIG. 3 consists, just as the other two embodiments, of a base 1, an intermediate piece 2, and a seat part 3.

The base 1 is identical to the base of the embodiment according to FIG. 1 so that reference is had at this point to the corresponding components of the description of FIG. 1.

The seat part 3 is substantially identical to the seat part in FIG. 2, but the use of a restoring weight is here omitted.

The seat part 3 is arranged on the head part 40 of the intermediate piece 2, designed in this case as a concave plate open in the upward direction. The radius of the head part 40 is slightly larger than the radius of the seat shell 14 of the seat part 3 and is selected so that the same distance to the seat shell 14 is provided in any point of the head part 40. This distance is essentially determined by the level of balls 41 arranged on the head part 40, these balls being arranged on the head part along a circular line central to the vertical axis of the head part 40. The balls 40 can be arranged, for example, in several cages for this purpose.

In this embodiment, a device for restoring the seat part 3 into the neutral position is eliminated. Moreover, in this embodiment, which is of an extremely simple structure, the seat part 3 is not connected to the head part 40 of the intermediate piece 2 and thus can be lifted off the latter.

The essential difference of this embodiment as compared with the embodiments of the invention illustrated in FIGS. 1 and 2 resides in the configuration of the intermediate piece 2.

This intermediate piece consists of a first hollow cylinder 42 arranged on the base 1 in the vertical axis, a second hollow cylinder 43 concentrically encompassing the first hollow cylinder and likewise being connected with the base 1, as well as of a hollow-cylindrical extension 44 of the head part 40. The inner diameter of the hollow-cylindrical extension 44 corresponds herein substantially to the outer diameter of the first hollow cylinder 42 so that the hollow-cylindrical extension 44 of the head part 40 encompasses the first hollow cylinder 42 and is guided by the latter in the vertical direction.

Between the first hollow cylinder 42 and, respectively, the hollow-cylindrical extension 44 and the second hollow cylinder 43, a coil spring 45 is provided, the outer diameter of which is selected to be slightly smaller than the inner diameter of the second hollow cylinder 43. The coil spring 45 rests with its lowermost winding on the base 1 and acts with its uppermost winding on a ring 46 connected with the jacket of the hollow-cylindrical extension 44, the outer diameter of this ring coresponding substantially to the inner diameter of the second hollow cylinder 43.

A rod 47 connected to the head part 40 and arranged in the vertical axis is extended by means of a bore through the upper wall 48 of the first hollow cylinder 42 and forms, together with the nut 49 threaded to the lower end of this rod, a device for tensioning the compression spring 45.

In case a load is exerted on the seat, the coil spring 45 is compressed by means of the ring 46 located on the periphery of the hollow-cylindrical extension 44, the rod 47 and, respectively, the nut 49 threaded thereto being moved downwards together with the top portion of the intermediate piece 2. In case the intermediate piece is relieved of its load, the upper portion thereof moves in the upward direction until the stop has been reached which is formed by the upper wall 48 of the first hollow cylinder 42 and the nut 49. In addition to functioning as a stop, the nut 49 moreover serves for setting the pretensioning of the coil spring 45 and thus the characteristic of the vertical springing of the intermediate piece 2.

Figure 4A:
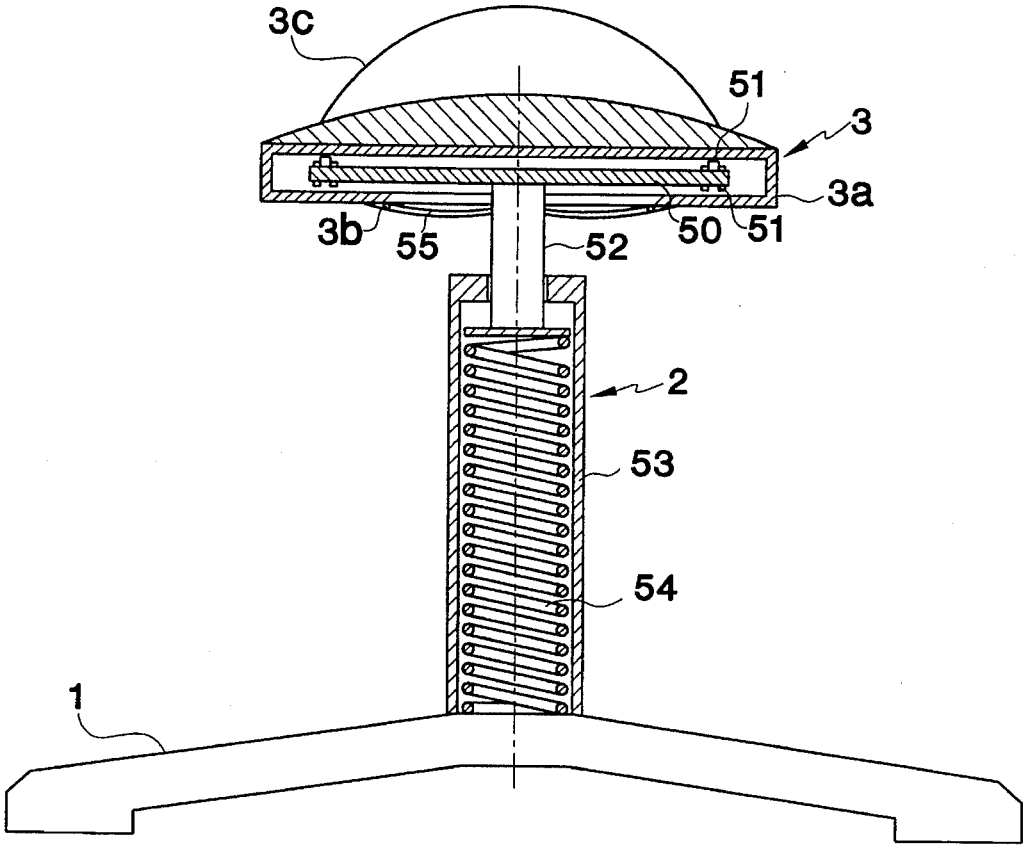
FIG. 4A shows a fourth embodiment of the seat according to this invention.

In the further embodiment of the invention, illustrated in FIG. 4*a*, the seat part 3 has a supporting part 3*a* designed, for example, as a hollow cylindrical member exhibiting in its lower wall a preferably circular opening 3*b*, a seat cushion of the above-described type being arranged on top of this member. Additionally, the seat part 3 has a back 3*c* which, however, has merely such a low height that even though an improvement in the sitting comfort is obtained the active dynamic sitting position is not impaired.

A head part 50 of the intermediate piece 2 engages through the opening 3*b* of the supporting part 3*a*; by means of balls 51 preferably retained in cages, the head part is supported in the supporting part to be displaceable in a horizontal plane. On account of the mounting of the head part 50 at the upper and lower inner wall of the supporting part 3*a*, an undesirable tilting or lift-off of the seat part 3 from the intermediate piece 2 is avoided. The head part 50 can be designed as a circular plate, a cylindrical extension 52 being arranged on its underside; this extension is guided in the vertical direction in a lower hollow cylinder 53 of the intermediate piece 2 connected with the base 1.

To provide vertical resiliency of the intermediate piece 2, a coil spring 54 is arranged, for example, in the lower hollow cylinder 53; this spring acts on the cylindrical extension 52 of the head part 50. The spring 54 can, of course, be pretensioned by suitable devices not illustrated in detail.

Shifting of the seat part 3 with respect to the intermediate piece 2 takes place against the bias of a device for restoring the unstressed seat part 3 into a neutral position. The restoring device can be designed for this purpose, for example, as a rubber diaphragm 55 arranged between the cylindrical extension 52 and the lower wall of the supporting part 3*a*.

Figure 4B:
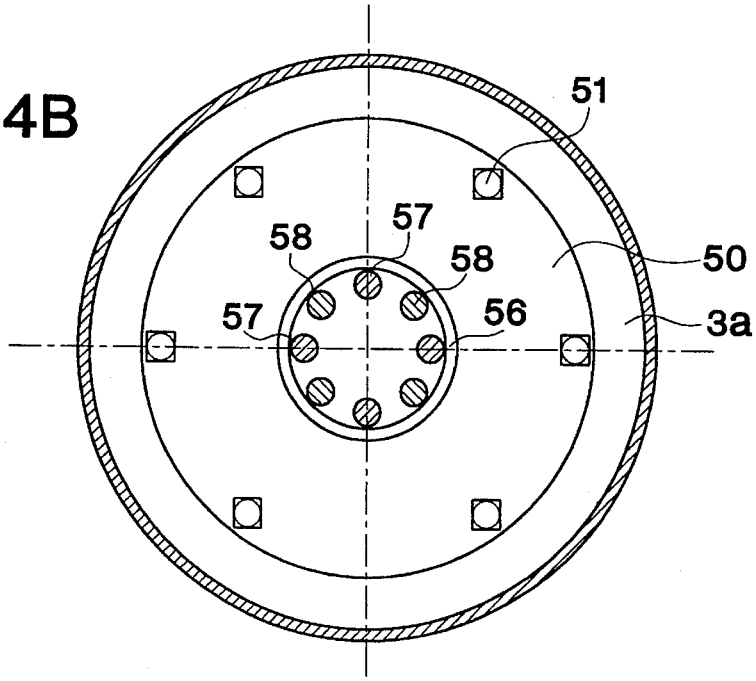
FIG. 4B shows a special configuration of the restoring device in the embodiment of FIG. 4A.

Another possibility for realizing the restoring device resides in the provision of an elastic ring element 56 in the interspace between the upper or lower inner wall of the supporting part 3*a* and the topside or bottom side of the head part 50, as shown in FIG. 4*b*. The ring element 56 is engaged, on the one hand, by several pins 57 connected to the supporting part 3*a* and, on the other hand, by several pins 58 connected to the head part 50, so that upon a deflection of the seat part 3 from the neutral position the pins 57 connected to the supporting part 3*a* will stretch the elastic ring element 56 held by the pins 58 whereby a corresponding restoring force is produced. In the arrangement of the pins 57 and 58, care must be taken that these do not impede the (though relatively minor) deflection of the seat part 3 in any desired direction of the plane.

The stop for the displacement movement of the seat part can be determined, for example, by a suitable choice of the diameter of the opening 3*b* of the supporting part 3*a* with respect to the outer diameter of the cylindrical extension 52, or by a corresponding selection of the outer diameter of the head part 50 with respect to the inner diameter of the supporting part 3*a*.

The invention, of course, is not restricted to the embodiments illustrated in FIGS. 1–4, but rather encompasses, in particular, also the combinations resulting from an exchange of the bases, the intermediate pieces, as well as the seat parts of the described embodiments.

I claim:

1. An active dynamic seat, comprising a base, an intermediate piece connected to the base, a seat part connected to the intermediate piece and a restoring device, characterized in that the intermediate piece is resilient in the vertical direction and has a head part having a bearing, that the seat part has a lower seat shell having a surface convex in the downward direction, and that the seat part is mounted to be supported in the vertical direction and to be tiltable into any other direction by the bearing engaging the seat shell, and that the restoring device acts to restore the seat part into a neutral position and includes an elastic element attached approximately centrally to an under side of the seat shell and in an axis of at least one of the head part and the intermediate piece.

2. The seat according to claim 1, characterized in that the intermediate piece includes a first cylindrical part connected with the head part, a second cylindrical part connected to the base, at least one of the first and second cylindrical parts being hollow, the first and second cylindrical parts nesting one in the other in telescopic fashion, and a coil spring being arranged therein.

3. The seat according to claim 1, characterized in that the base includes a contact surface that is curved slightly convexly in the downward direction.

4. The seat according to claim 1, characterized in that the shape of the seat shell is a spherical section.

5. The seat according to claim 1 or 4, characterized in that the bearing has a plurality of balls, each of said plurality of balls being rotatably supported in a cage arranged along a substantially horizontal circular line.

6. The seat according to claim 5, characterized in that the plurality of balls are spaced along the circular line at substantially equidistant intervals.

7. The seat according to claim 1, characterized in that the elastic element includes at least one of a spiral spring and an elastic band.

8. The seat according to claim 1 or claim 7, characterized in that the elastic element is pretensioned.

9. The seat according to claim 1, characterized in that the seat part further includes a seat cushion, the seat cushion being fixedly connected to the seat part, said cushion having a shape selected from the group consisting of planar, convex, concave, and wedge.

10. The seat according to claim 9, characterized in that the seat cushion (13) has a core structure, said core structure being substantially dimensionally stable even under load.

11. The seat according to claim 1, characterized in that the seat part further includes a seat cushion, the seat cushion being releasably connected to the seat part, said cushion having a shape selected from the group consisting of planar, convex, concave, and wedge.

12. The seat according to claim 11, characterized in that the seat cushion has a core structure, said core structure being substantially dimensionally stable even under load.

13. The seat according to claim 1, characterized in that the head part has a concave surface corresponding to the shape of the seat shell and the bearing is a sliding bearing.

14. The seat according to claim 13, characterized in that the convex surface of the seat shell includes a portion consisting of a flexible but dimensionally stable material.

15. The seat according to claim 14, characterized in that the material has a low friction coefficient.

16. The seat according to claim 1, characterized in that the intermediate piece (2) comprises a hollow-cylindrical extension (44) with a ring (46) arranged on its outside and with a first lower hollow cylinder (42) connected to the base (1), the extension being connected with the head part (7, 25, 40), wherein the first lower hollow cylinder engages telescopically with the hollow-cylindrical extension (44), and further comprises a second lower hollow cylinder (43) connected to the base (1), the inner diameter of the second hollow cylinder corresponding approximately to the outer diameter of the ring (46) arranged at the hollow-cylindrical extension (44); and that a coil spring (45) is located between the hollow-cylindrical extension (44) and the first lower hollow cylinder (42) as well as the second lower hollow cylinder (43).

17. The seat according to claim 16, characterized in that the intermediate piece (2) includes a device for pretensioning the coil spring (45), said device engaging with at least one of a group consisting of the first lower hollow cylinder (42), the base (1), the hollow-cylindrical extension (44) and the head part (40).

18. Seat according to claim 17, characterized in that the intermediate piece (2) is connected to the base (1) by way of a connecting element (22) that can be bent into any direction.

19. The seat according to claim 18, characterized in that the connecting element (22) is fashioned as a vibration mount.

20. The seat according to claim 18, characterized in that the base (1) includes at a predetermined level above a supporting surface thereof, a stop in the form of a closed frame (21) which limits a lateral movement of the intermediate piece (2).

21. The seat according to claim 18, characterized in that the base (1) comprises several restoring devices (27) which, distributed over the periphery of the intermediate piece (2), engage the latter.

22. The seat according to claim 21, characterized in that the restoring devices (27) comprise tension elements (28), deflection elements (29), and resilient elements (30), and that at least parts of the restoring devices (27) are arranged in a base part (20) of the base (1), this base part being of an at least partially hollow structure for this purpose.

* * * * *